US008292685B2

(12) United States Patent
Takeda et al.

(10) Patent No.: US 8,292,685 B2
(45) Date of Patent: Oct. 23, 2012

(54) METHOD FOR PRODUCING PLASMA DISPLAY PANEL

(75) Inventors: Eiji Takeda, Osaka (JP); Takuji Tsujita, Osaka (JP); Jun Hashimoto, Osaka (JP); Masashi Gotou, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/148,146

(22) PCT Filed: Mar. 16, 2011

(86) PCT No.: PCT/JP2011/001526

§ 371 (c)(1),
(2), (4) Date: Aug. 5, 2011

(87) PCT Pub. No.: WO2011/118152

PCT Pub. Date: Sep. 29, 2011

(65) Prior Publication Data

US 2012/0184172 A1 Jul. 19, 2012

(30) Foreign Application Priority Data

Mar. 26, 2010 (JP) ..... 2010-071980

(51) Int. Cl.
*H01J 9/26* (2006.01)
*H01J 9/32* (2006.01)

(52) U.S. Cl. ..... 445/25; 445/58; 427/68

(58) Field of Classification Search ..... 445/24, 445/25, 58; 313/587; 427/68, 327.2, 66
See application file for complete search history.

(56) References Cited

U.S. PATENT DOCUMENTS

2010/0102723 A1 4/2010 Mizokami et al.
2010/0255748 A1 * 10/2010 Imanaka et al. ..... 445/58
2010/0266750 A1 * 10/2010 Morita et al. ..... 427/71

(Continued)

FOREIGN PATENT DOCUMENTS

JP 2002-260535 9/2002

(Continued)

OTHER PUBLICATIONS

International Search Report issued Apr. 12, 2011 in International (PCT) Application No. PCT/JP2011/001526.

(Continued)

*Primary Examiner* — Mariceli Santiago
*Assistant Examiner* — Glenn Zimmerman
(74) *Attorney, Agent, or Firm* — Wenderoth, Lind & Ponack, L.L.P.

(57) ABSTRACT

A method for producing a plasma display panel having a base layer including metallic oxides and agglomerated particles dispersed on the base layer includes the following steps of: forming the base layer on the dielectric layer; spreading an organic solvent in which the agglomerated particles are dispersed on the base layer to form a coating layer thereon; drying the coating layer under a reduced pressure to form an organic solvent coating film on at least the base layer; disposing the rear plate and the front plate on which the coating film is formed so as to face each other; heating the front plate and the rear plate facing each other to evaporate the coating film, dispersing the agglomerated particles on the base layer, and removing components of the evaporated coating film from the discharge space; and sealing the rear plate and the front plate from which the coating film is evaporated to each other.

7 Claims, 7 Drawing Sheets

U.S. PATENT DOCUMENTS

| | | | | |
|---|---|---|---|---|
| 2011/0001427 | A1 | 1/2011 | Betsui et al. | |
| 2012/0052761 | A1 * | 3/2012 | Lin et al. | 445/24 |

FOREIGN PATENT DOCUMENTS

| | | |
|---|---|---|
| JP | 2009-129616 | 6/2009 |
| JP | 2009-218133 | 9/2009 |
| JP | 2010-80388 | 4/2010 |
| WO | 2009/044456 | 4/2009 |

OTHER PUBLICATIONS

Written Opinion of the International Searching Authority issued Apr. 12, 2011 in International (PCT) Application No. PCT/JP2011/001526.

* cited by examiner

METHOD FOR PRODUCING PLASMA DISPLAY PANEL

TECHNICAL FIELD

The technology disclosed herein relates to a method for producing a plasma display panel used in, for example, a display device.

BACKGROUND ART

A plasma display panel (hereinafter, called PDP) has a front plate and a rear plate. The front plate includes a glass substrate, display electrodes formed on a main surface of the glass substrate, a dielectric layer covering the display electrodes to function as a capacitor, and a protective layer made of magnesium oxide (MgO) formed on the dielectric layer. Meanwhile, the rear plate includes a glass substrate, data electrodes formed on a main surface of the glass substrate, a base dielectric layer covering the data electrodes, barrier ribs formed on the base dielectric layer, and phosphor layers respectively formed between the barrier ribs to emit red, green, and blue light.

The front plate and the rear plate are air-tightly sealed to each other with their electrode-formed surfaces facing each other. A discharge gas containing neon (Ne) and xenon (Xe) is enclosed in a discharge space divided by the barrier ribs. The discharge gas is electrically discharged to generate light when a video signal voltage is selectively applied to the display electrodes. The electric discharge generates ultraviolet light, and the generated ultraviolet light excites the phosphor layers. The excited phosphor layers respectively emit the red, green, and blue light. This is the mechanism of a color image display in PDP (see Patent Document 1).

There are four main functions exerted by the protective layer; 1) protect the dielectric layer from the impact of ions through the electric discharge, 2) release primary electrons to cause data discharge, 3) retain charges for causing the electric discharge, and 4) release secondary electrons during sustain discharge. Because the dielectric layer is protected from the ion-induced impact, a discharge voltage is prevented from increasing. As more primary electrons are released, a data discharge error, which is a factor responsible for flickering images, is reduced. Improvement of a charge retainability lowers a voltage to be applied, and increase of secondary electrons to be released lowers a sustain discharge voltage. An attempt for increasing the primary electrons to be released is to add, for example, silicon (Si) or aluminum (Al) to MgO of the protective layer (for example, see Patent Documents 1, 2, 3, 4, and 5).

PRIOR ART DOCUMENTS

Patent Documents

Patent Document 1: Unexamined Japanese Patent Publication No. 2002-260535

Patent Document 2: Unexamined Japanese Patent Publication No. 11-339665

Patent Document 3: Unexamined Japanese Patent Publication No. 2006-59779

Patent Document 4: Unexamined Japanese Patent Publication No. 08-236028

Patent Document 5: Unexamined Japanese Patent Publication No. 10-334809

DISCLOSURE OF THE INVENTION

The present invention provides a method for producing a PDP having a rear plate and a front plate sealed to the rear plate with a discharge space interposed therebetween. The front plate includes a dielectric layer and a protective layer which covers the dielectric layer. The protective layer includes a base layer formed on the dielectric layer. Agglomerated particles in which crystal particles of magnesium oxide are agglomerated to one another are dispersed evenly on an entire surface of the base layer. The base layer includes at least a first metallic oxide and a second metallic oxide. The base layer further has at least a peak through an X-ray diffraction analysis. The peak of the base layer is present at an intermediate position between a first peak through an X-ray diffraction analysis of the first metallic oxide and a second peak through an X-ray diffraction analysis of the second metallic oxide. The first peak and the second peak indicate a plane orientation equal to a plane orientation indicated by the peak of the base layer. The first metallic oxide and the second metallic oxide are two selected from a group consisting of magnesium oxide, calcium oxide, strontium oxide, and barium oxide.

The method for producing the PDP includes the steps of: forming the base layer on the dielectric layer; spreading an organic solvent in which the agglomerated particles are dispersed on the base layer to form a coating layer; drying the coating layer under a reduced pressure to form an organic solvent coating film on at least the base layer; disposing the rear plate and the front plate on which the coating film is formed so as to face each other; heating the front plate and the rear plate facing each other to evaporate the coating film, dispersing the agglomerated particles on the base layer, and removing components of the evaporated coating film from the discharge space; and sealing the rear plate and the front plate from which the coating film is evaporated to each other.

PREFERRED EMBODIMENTS FOR CARRYING OUT OF THE INVENTION

[1. Basic Structure of PDP]

Figure 1:
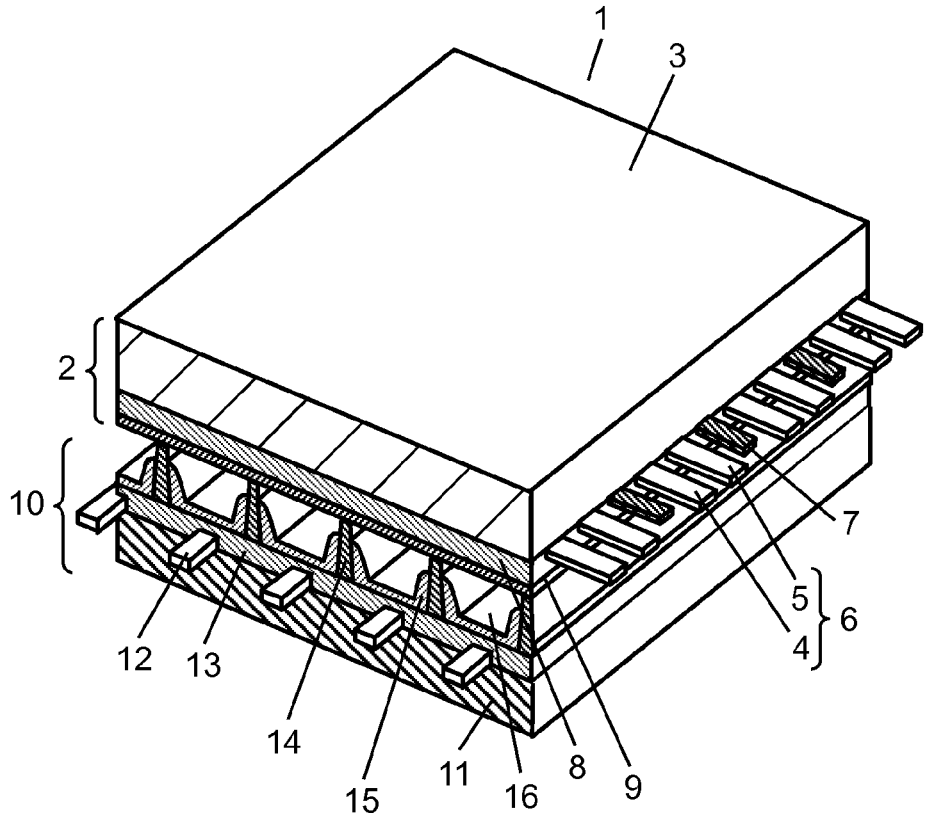
FIG. 1 is a perspective view illustrating a structure of PDP according to an embodiment.

A basic structure of PDP is a general AC surface discharge PDP. As illustrated in FIG. 1, PDP 1 has a structure where front plate 2 including front glass substrate 3 and rear plate 10 including rear glass substrate 11 are disposed facing each other. Outer peripheral portions of front plate 2 and rear plate 10 are air-tightly sealed to each other by a sealing member made of, for example, glass frit. A discharge gas containing, for example, Ne and Xe is enclosed in discharge space 16 formed in PDP 1 by the sealed plates under a pressure in the range of 53 kPa to 80 kPa.

Figure 2:
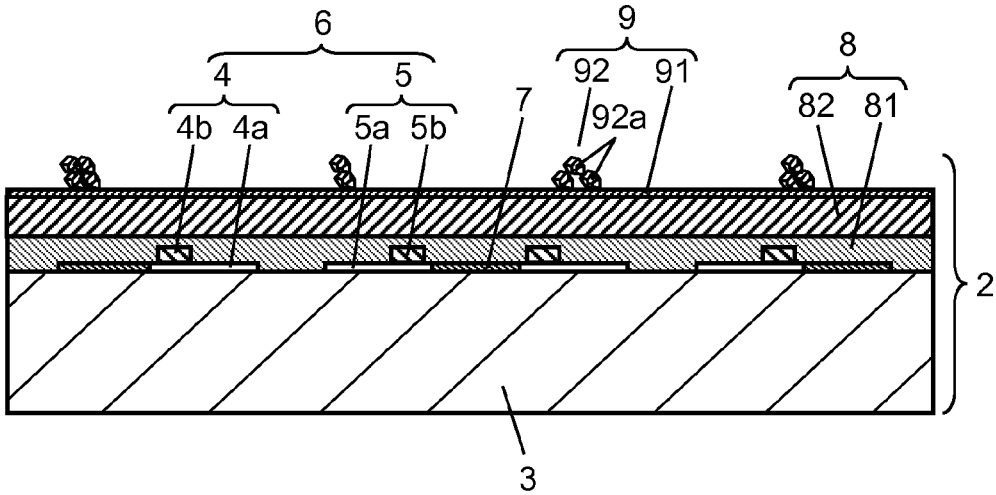
FIG. 2 is a sectional view illustrating a structure of a front plate according to the embodiment.

A plurality of pairs of band-shape display electrodes 6 each including scan electrode 4 and sustain electrode 5 and a plurality of black stripes 7 are provided on front glass substrate 3 in parallel with each other. Dielectric layer 8 functioning as a capacitor is formed on front glass substrate 3 so as to cover display electrodes 6 and black stripes 7. A surface of dielectric layer 8 is coated with protective layer 9 made of, for example, MgO. As illustrated in FIG. 2, protective layer 9 according to the embodiment includes base film 91 which is a base layer provided on dielectric layer 8, and agglomerated particles 92 which adhere to a surface of base film 91.

Scan electrodes 4 and sustain electrodes 5 are transparent electrodes made of an electrically conductive metallic oxide such as indium tin oxide (ITO), tin dioxide ($SnO_2$), or zinc oxide (ZnO) on which bus electrodes containing Ag are formed.

A plurality of data electrodes 12 made of an electrically conductive material containing silver (Ag) as its principal ingredient is formed on rear glass substrate 11 in parallel with each other in a direction orthogonal to display electrodes 6. Data electrodes 12 are coated with base dielectric layer 13. Barrier ribs 14 are formed to a predetermined height on base dielectric layer 13 between data electrodes 12 to divide discharge space 16. Phosphor layers are sequentially formed on base dielectric layer 13 and side surfaces of barrier ribs 14 for each of data electrodes 12, the phosphor layers are respectively; phosphor layer 15 which emits red light, phosphor layer 15 which emits green light, and phosphor layer 15 which emits blue light, each layer emitting light in response to ultraviolet light. A discharge cell is formed at a position where display electrode 6 and data electrode 12 intersect with each other. The discharge cells respectively having red, green, and blue phosphor layers 15 arranged in the direction of display electrodes 6 constitute color display pixels.

In the present embodiment, the discharge gas enclosed in discharge space 16 includes Xe by no less than 10 vol. % and no more than 30 vol. %.

[2. PDP Production Method]

Next, a method for producing PDP 1 is described.

Figure 3:
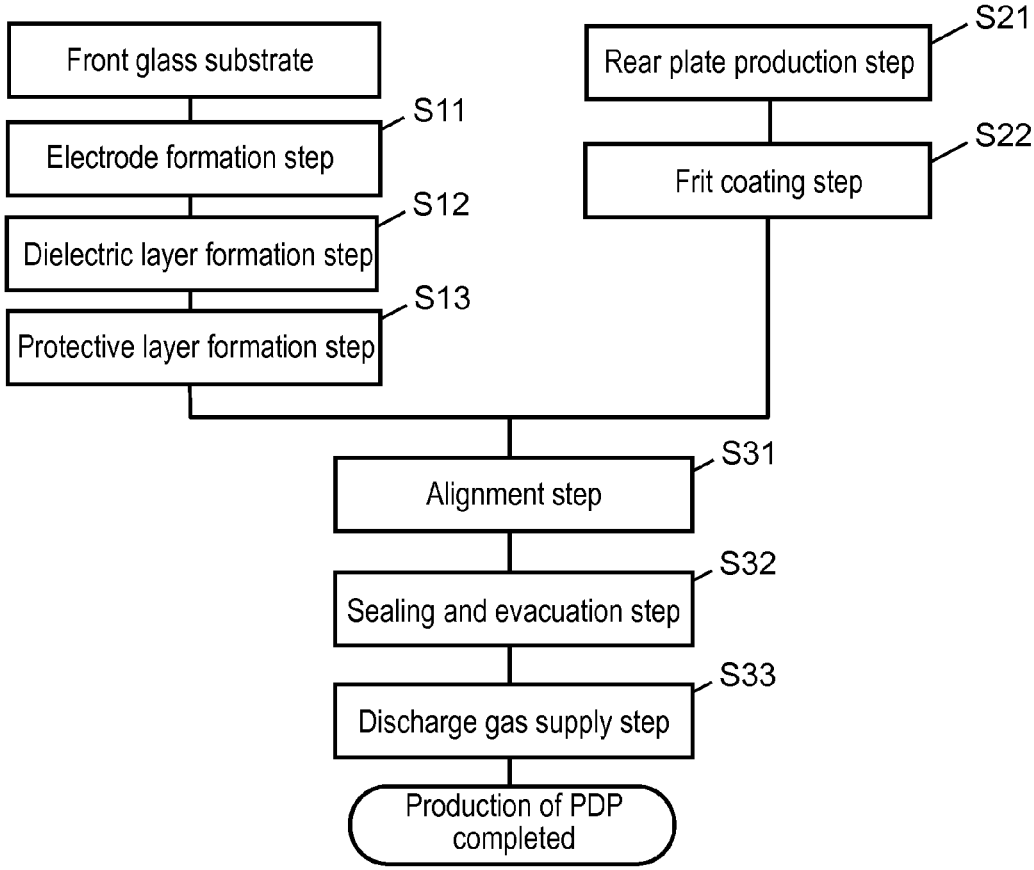
FIG. 3 is a flow chart illustrating PDP production steps according to the embodiment.

First, a method for producing front plate 2 is described. In electrode formation step S11, scan electrodes 4, sustain electrodes 5, and black stripes 7 are formed on front glass substrate 3 by photolithography as illustrated in FIG. 3. Scan electrodes 4 and sustain electrodes 5 respectively have bus electrodes 4*b* and 5*b* including Ag to ensure an electrical conductivity. Scan electrodes 4 and sustain electrodes 5 further include transparent electrodes 4*a* and 5*a*, respectively. Bus electrodes 4*b* are provided on transparent electrodes 4*a*, and bus electrodes 5*b* are provided on transparent electrodes 5*a*.

A material such as ITO is used to form transparent electrodes 4*a* and 5*a* to ensure a degree of transparency and an electrical conductivity. First, an ITO thin film is formed on front glass substrate 3 by sputtering. Then, transparent electrodes 4*a* and 5*a* are formed in a predetermined pattern by lithography.

A material used to form bus electrodes 4*b* and 5*b* is, for example, a white paste containing a glass frit, a photosensitive resin, and a solvent to increase an Ag—Ag binding capacity. First, the white paste is spread on front glass substrate 3 by screen printing, and the solvent in the white paste is removed in a baking oven. Next, the while paste is exposed to light via a photo mask formed in a predetermined pattern.

Then, the white paste is developed so that a bus electrode pattern is formed. Lastly, the bus electrode pattern is fired in a baking oven at a predetermined temperature so that the photosensitive resin in the bus electrode pattern is removed. Further, the glass frit in the bus electrode pattern is melted as the bus electrode pattern is fired, and the melted glass frit starts to vitrify again after the firing is over. As a result of these steps, bus electrodes 4*b* and 5*b* are formed.

Black stripes 7 are formed from a material including a black pigment. Black stripes 7 are formed between display electrodes 6 by, for example, screen printing.

Then, dielectric layer 8 is formed in dielectric layer formation step S12. A material used to form dielectric layer 8 is, for example, a dielectric paste including a dielectric glass frit, a resin, and a solvent. First, the dielectric paste is spread in a predetermined thickness on front glass substrate 3 by die coating so as to cover scan electrodes 4, sustain electrodes 5, and black stripes 7. Next, the solvent in the dielectric paste is removed in a baking oven. Lastly, the dielectric paste is fired in a baking oven at a predetermined temperature so that the resin in the dielectric paste is removed. Further, the dielectric glass frit is melted as the dielectric paste is fired, and the melted dielectric glass frit starts to vitrify again after the firing is over. As a result of step S12, dielectric layer 8 is formed. In place of die coating employed to apply the dielectric paste, screen printing or spin coating may be employed. Instead of using the dielectric paste, a film used as dielectric layer 8 may be formed by CVD (Chemical Vapor Deposition). Dielectric layer 8 will be described in detail later.

In protective layer formation steps S13, protective layer 9 including base film 91 and agglomerated particles 92 is formed on dielectric layer 8. Further, coating film 17 containing an organic solvent is formed on base film 91. Protective layer 9 and protective layer formation steps S13 will be described in detail later.

As a result of steps S11 to S13 described so far, scan electrodes 4, sustain electrodes 5, black stripes 7, dielectric layer 8, and protective layer 9 are formed on front glass substrate 3, and the production of front plate 2 is completed.

Next, rear plate production step S21 is described. Data electrodes 12 are formed on rear glass substrate 11 by photolithography. A material used to form data electrodes 12 is, for example, a data electrode paste containing a glass frit, a photosensitive resin, and a solvent to increase an Ag—Ag binding capacity for ensuring an electrical conductivity. First, the data electrode paste is spread in a predetermined thickness on rear glass substrate 11 by screen printing, and the solvent in the data electrode paste is removed in a baking oven. Then, the data electrode paste is exposed to light via a photo mask formed in a predetermined pattern. Then, the data electrode paste is developed so that a data electrode pattern is formed. Lastly, the data electrode pattern is fired in a baking oven at a predetermined temperature so that the photosensitive resin in the data electrode pattern is removed. Further, the glass frit in the data electrode pattern is melted as the data electrode pattern is fired, and the melted glass frit starts to vitrify again after the firing is over. As a result of these steps, data electrodes 12 are formed. In place of screen printing employed to apply the data electrode paste, sputtering or vapor deposition may be employed.

Then, base dielectric layer 13 is formed. A material used to form base dielectric layer 13 is, for example, a base dielectric paste containing a dielectric glass frit, a resin, and a solvent. First, the base dielectric paste is spread in a predetermined thickness by screen printing on rear glass substrate 11 having data electrodes 12 formed thereon so as to cover data electrodes 12. Then, the solvent in the base dielectric paste is removed in a baking oven. Lastly, the base dielectric paste is fired at a predetermined temperature in a baking oven so that the resin in the base dielectric paste is removed. Further, the dielectric glass frit is melted as the base dielectric paste is fired, and the melted glass frit starts to vitrify again after the firing is over. As a result of these steps, base dielectric layer 13 is formed. In place of screen printing employed to apply the base dielectric paste, die coating or spin coating may be employed. Instead of using the base dielectric paste, a film used as base dielectric layer 13 may be formed by, for example, CVD.

Next, barrier ribs 14 are formed by photolithography. A material used to form barrier ribs 14 is, for example, a barrier rib paste containing a filler, a glass frit as a filler binding agent, a photosensitive resin, and a solvent. The barrier rib paste is spread on base dielectric layer 13 in a predetermined thickness by die coating. Then, the solvent in the barrier rib paste is removed in a baking oven, and the barrier rib paste is exposed to light via a photo mask formed in a predetermined pattern. The barrier rib paste is then developed so that a barrier rib pattern is formed. Lastly, the barrier rib pattern is fired at a predetermined temperature in a baking oven so that the photosensitive resin in the barrier rib pattern is removed. Further, the glass frit in the barrier rib pattern is melted as the barrier rib pattern is fired, and the melted glass frit starts to vitrify again after the firing is over. As a result of these steps, barrier ribs 14 are formed. The photolithography may be replaced with sandblasting.

Next, phosphor layers 15 are formed. A material used to form phosphor layer 15 is, for example, a phosphor paste including a phosphor, a binder, and a solvent. First, the phosphor paste is spread by dispensing in a predetermined thickness on base dielectric layer 13 between adjacent barrier ribs 14 and side surfaces of barrier ribs 14. Then, the solvent in the phosphor paste is removed in a baking oven. Lastly, the phosphor paste is fired at a predetermined temperature in a baking oven so that the resin in the phosphor paste is removed. So far described is the formation process of phosphor layer 15. The dispensing may be replaced with screen printing or inkjetting.

As a result of rear plate production step S21 described so far, the production of rear plate 10 provided with the required structural elements on rear glass substrate 11 is completed.

In frit coating step S22, a sealing member (not illustrated in the drawings) is formed in a peripheral portion of rear plate 10 by dispensing. A material of the sealing member (not illustrated in the drawings) is a sealing paste containing a glass frit, a binder, and a solvent. Then, the solvent in the sealing paste is removed in a baking oven.

Then, front plate 2 and rear plate 10 are put together. In alignment step S31, front plate 2 and rear plate 10 are disposed facing each other so that display electrodes 6 and data electrodes 12 are orthogonal to each other.

In sealing and evacuation step S32 that follows, peripheral portions of front plate 2 and rear plate 10 are sealed by a glass frit, and air is evacuated from discharge space 16. Then, front plate 2 and rear plate 10 are heated so that coating film 17 is evaporated, and agglomerated particles 92 are dispersed on base film 91. Further, the components of evaporated coating film 17 are removed from discharge space 16.

In discharge gas supply step S33 which is the last step, the discharge gas containing Ne and Xe is enclosed in discharge space 16, and the production of PDP 1 is completed through the above steps.

[3. Details of Dielectric Layer]

Dielectric layer 8 is described in detail. First dielectric layer 81 and second dielectric layer 82 constitute dielectric layer 8. A dielectric material of first dielectric layer 81 includes the following components; dibismuth trioxide ($Bi_2O_3$) by 20 wt. % to 40 wt. %, at least one selected from a group consisting of calcium oxide (CaO), strontium oxide (SrO), and barium oxide (BaO) by 0.5 wt. % to 12 wt. %, and at least one selected from a group consisting of molybdenum trioxide ($MoO_3$), tungsten trioxide ($WO_3$), cerium dioxide ($CeO_2$), and manganese dioxide ($MnO_2$) by 0.1 wt. % to 7 wt. %.

In place of the group consisting of $MoO_3$, $WO_3$, $CeO_2$, and $MnO_2$, at least one selected from a group consisting of copper oxide (CuO), dichrome trioxide ($Cr_2O_3$), cobalt trioxide ($CO_2O_3$), divanadium heptoxide ($V_2O_7$), and diantimony trioxide ($Sb_2O_3$) may be included by 0.1 wt. % to 7 wt. %.

Other than the foregoing components, any of the following components not containing lead may be included; ZnO by 0 wt. % to 40 wt. %, diboron trioxide ($B_2O_3$) by 0 wt. % to 35 wt. %, silicon dioxide ($SiO_2$) by 0 wt. % to 15 wt. %, and aluminum trioxide ($Al_2O_3$) by 0 wt. % to 10 wt. %.

To produce the powderized dielectric material, the dielectric material is ground by a wet jet mill or a ball mill so that an average particle diameter is 0.5 μm to 2.5 μm. When the powderized dielectric material by 55 wt. % to 70 wt. % and a binder component by 30 wt. % to 45 wt. % are kneaded well by a three-roll mill, a paste for first dielectric layer used in die coating or printing is obtained.

The binder component is ethyl cellulose, or terpineol or butyl carbitol acetate including acrylic resin by 1 wt. % to 20 wt. %. If necessary, dioctyl phthalate, dibutyl phthalate, triphenyl phosphate, or tributyl phosphate may be further added to the paste as a plasticizer, and glycerol mono-oleate, sorbitan sesquioleate, HOMOGENOL (product supplied by Kao Corporation), alkylaryl phosphate, or the like may be further added to the paste as a dispersant. The addition of the dispersant improves a level of printability.

The paste for first dielectric layer is printed on front glass substrate 3 by die coating or screen printing so as to cover display electrodes 6. The paste for first dielectric layer thus printed is dried and then fired at 575° C. to 590° C. slightly higher than the softening point of the dielectric material so that first dielectric layer 81 is formed.

Next, second dielectric layer 82 is described. A dielectric material of second dielectric layer 82 includes the following components; $Bi_2O_3$ by 11 wt. % to 20 wt. %, at least one selected from CaO, SrO, and BaO by 1.6 wt. % to 21 wt. %, and at least one selected from a group consisting of $MoO_3$, $WO_3$, and $CeO_2$ by 0.1 wt. % to 7 wt. %.

In place of $MoO_3$, $WO_3$, and $CeO_2$, at least one selected from CuO, Cr2O3, $Co_2O_3$, $V_2O_7$, $Sb_2O_3$, and $MnO_2$ may be included by 0.1 wt. % to 7 wt. %.

Other than the foregoing components, any of the following components not containing lead may be included; ZnO by 0 wt. % to 40 wt. %, $B_2O_3$ by 0 wt. % to 35 wt. %, $SiO_2$ by 0 wt. % to 15 wt. %, and $Al_2O_3$ by 0 wt. % to 10 wt. %.

To produce the powderized dielectric material, the dielectric material is ground by a wet jet mill or a ball mill so that an average particle diameter is 0.5 μm to 2.5 μm. When the powderized dielectric material by 55 wt. % to 70 wt. % and a binder component by 30 wt. % to 45 wt. % are kneaded well by a three-roll mill, a paste for second dielectric layer used in die coating or printing is obtained.

The binder component is ethyl cellulose, or terpineol or butyl carbitol acetate including acrylic resin by 1 wt. % to 20 wt. %. If necessary, dioctyl phthalate, dibutyl phthalate, triphenyl phosphate, or tributyl phosphate may be further added to the paste as a plasticizer, and glycerol mono-oleate, sorbitan sesquioleate, HOMOGENOL (product supplied by Kao Corporation), alkylaryl phosphate, or the like may be further added to the paste as a dispersant. The addition of the dispersant improves a level of printability.

The paste for second dielectric layer is printed on first dielectric layer 81 by die coating or screen printing. The paste for second dielectric layer thus printed is dried and then fired at 550° C. to 590° C. slightly higher than the softening point of the dielectric material so that second dielectric layer 82 is formed.

To ensure a good transmission factor of visible light, dielectric layer 8 preferably has a film thickness no more than 41 μm with first dielectric layer 81 and second dielectric layer 82 altogether.

To control a reaction of bus electrodes 4*b* and 5*b* with Ag, a larger volume of $Bi_2O_3$ is included in first dielectric layer 81 than $Bi_2O_3$ included in second dielectric layer 82, more specifically, $Bi_2O_3$ is included in first dielectric layer 81 by 20 wt. % to 40 wt. %. This makes the visible light transmission factor of first dielectric layer 81 lower than that of second dielectric layer 82. Therefore, first dielectric layer 81 is formed in a smaller film thickness than second dielectric layer 82.

When $Bi_2O_3$ is included in second dielectric layer 82 by less than 11 wt. %, the possibility of color staining is lessened, however, air bubbles are more easily generated in second dielectric layer 82. Therefore, it is not preferable to include $Bi_2O_3$ by less than 11 wt. %. When the rate of content of $Bi_2O_3$ exceeds 40 wt. %, the possibility of color staining increases, deteriorating the visible light transmission factor. Therefore, it is not preferable to include $Bi_2O_3$ by more than 40 wt. %.

As the film thickness of dielectric layer 8 is smaller, such effects as improvement of a luminance level and reduction of a discharge voltage become more prominent. Therefore, it is desirable to make the film thickness of dielectric layer 8 as small as possible to such an extent that a breakdown voltage thereof is not thereby deteriorated.

In view of these technical aspects, the film thickness of dielectric layer 8 according to the present embodiment is no more than 41 μm, wherein first dielectric layer 81 has the film thickness of 5 μm to 15 μm, and second dielectric layer 82 has the film thickness of 20 μm to 36 μm.

It was confirmed that PDP 1 thus produced can control the color staining (turning yellow) of front glass substrate 3 and air bubbles generated in dielectric layer 8 regardless of Ag used in display electrodes 6, thereby significantly improving the breakdown voltage of dielectric layer 8.

Below is discussed why these dielectric materials can prevent first dielectric layer 81 from turning yellow and control the generation of air bubbles therein in PDP 1 according to the present embodiment. It is already known that such compounds as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are more easily generated at low temperatures no more than 580° C. by adding $MoO_3$ or $WO_3$ to dielectric glass containing $Bi_2O_3$. According to the present embodiment wherein the firing temperature of dielectric layer 8 is 550° C. to 590° C., silver ions ($Ag^+$) diffused in dielectric layer 8 during firing react with $MoO_3$, $WO_3$, $CeO_2$, and $MnO_2$ in dielectric layer 8 and generate stable compounds, thereby stabilizing $Ag^+$. Thus, the stabilization can be accomplished without the reduction of $Ag^+$, and such an unfavorable event is avoidable that $Ag^+$ starts to agglutinate, generating colloids. The stabilization of $Ag^+$ lessens oxygen generated by the collidization of Ag, thereby lessening air bubbles generated in dielectric layer 8.

To further improve these effects, $MoO_3$, $WO_3$, $CeO_2$, or $MnO_2$ is preferably included in the dielectric glass containing $Bi_2O_3$ by no less than 0.1 wt. %, and more preferably by no less than 0.1 wt. % and no more than 7 wt. % because the turning-yellow event is not very effectively prevented from happening if less than 0.1 wt. %, and the glass is unfavorably color-stained if more than 7 wt. %.

As described so far, dielectric layer 8 of PDP 1 according to the present embodiment is technically advantageous in that first electric layer 81 made of Ag and contacting bus electrodes 4*b* and 5*b* controls the turning-yellow event and the generation of air bubbles, and second dielectric layer 82 provided on first dielectric layer 81 helps to accomplish a high light transmission factor. As a result, in any PDP provided with dielectric layer 8 having such remarkable layers that can prevent turning yellow, control the generation of air bubbles, and achieve a good light transmission factor.

[4. Details of Protective Layer]

Protective layer 9 includes base film 91 which is a base layer and agglomerated particles 92. Base film 91 includes at least a first metallic oxide and a second metallic oxide. The first metallic oxide and the second metallic oxide are two selected from a group consisting of MgO, CaO, SrO, and BaO. Base film 91 further has at least a peak through an X-ray diffraction analysis. The peak is present at an intermediate position between a first peak through an X-ray diffraction analysis of the first metallic oxide and a second peak through an X-ray diffraction analysis of the second metallic oxide. The first peak and the second peak indicate a plane orientation equal to a plane orientation indicated by the peak of base film 91.

[4-1. Details of Base Film]

Figure 4:
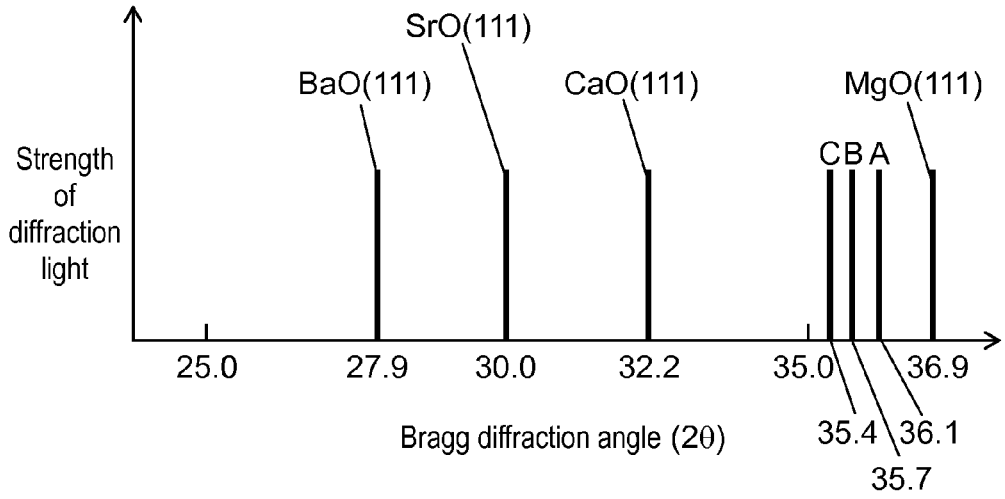
FIG. 4 is a graph illustrating X-ray diffraction analysis results obtained from a surface of a base film according to the embodiment.

FIG. 4 illustrates X-ray diffraction analysis results obtained from the surface of base film 91 constituting protective layer 9 of PDP 1 according to the present embodiment. FIG. 4 further illustrates X-ray diffraction analysis results obtained from MgO, CaO, SrO, and BaO each singly used.

In FIG. 4, a lateral axis represents the Bragg diffraction angle (2θ), and a longitudinal axis represents the strength of an X-ray diffracted wave. The diffraction angle is expressed by 360 degrees in a full circle, and the strength is expressed by an arbitrary unit. A crystalline orientation plane, which is a specific orientation plane, is bracketed.

As illustrated in FIG. 4, CaO used as a single component in the plane orientation of (111) has a peak at the diffraction angle of 32.2 degrees. MgO used as a single component has a peak at the diffraction angle of 36.9 degrees. SrO used as a single component has a peak at the diffraction angle of 30.0 degrees. BaO used as a single component has a peak at the diffraction angle of 27.9 degrees.

In PDP 1 according to the present embodiment, base film 91 of protective layer 9 includes at least two metallic oxides selected from a group consisting of MgO, CaO, SrO, and BaO.

FIG. 4 illustrates X-ray diffraction results in the case where two single components constitute base film 91. Point A shows the X-ray diffraction result of base film 91 in which MgO and CaO are each used as a single component. Point B shows the X-ray diffraction result of base film 91 in which MgO and SrO are each used as a single component. Point C shows the X-ray diffraction result of base film 91 in which MgO and BaO are each used as a single component.

As illustrated in FIG. 4, Point A has a peak at the diffraction angle of 36.1 degrees in the plane orientation of (111). MgO alone constituting the first metallic oxide has a peak at the diffraction angle of 36.9 degrees. CaO alone constituting the second metallic oxide has a peak at the diffraction angle of 32.2 degrees. Therefore, the peak of Point A is present between the peaks of MgO and CaO each used as a single component. Similarly, Point B has a peak at the diffraction angle of 35.7 degrees, and Point B is present between the peaks of MgO constituting the first metallic oxide and SrO constituting the second metallic oxide each used as a single component. Point C has a peak at the diffraction angle of 35.4 degrees, and Point C is present between the peaks of MgO constituting the first metallic oxide and BaO constituting the second metallic oxide each used as a single component.

Figure 5:
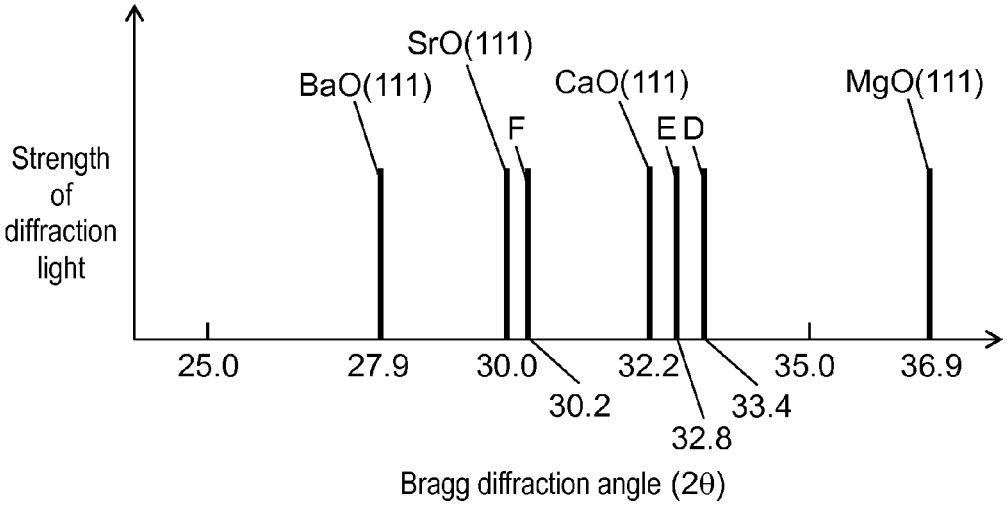
FIG. 5 is a graph illustrating X-ray diffraction analysis results obtained from a surface of another base film according to the embodiment.

FIG. 5 illustrates X-ray diffraction results in the case where three single components constitute base film 91. Point D shows the X-ray diffraction result of base film 91 in which MgO, CaO, and SrO are each used as a single component. Point E shows the X-ray diffraction result of base film 91 in which MgO, CaO and BaO are each used as a single component. Point F shows the X-ray diffraction result of base film 91 in which CaO, SrO, and BaO are each used as a single component.

As illustrated in FIG. 5, Point D has a peak at the diffraction angle of 33.4 degrees in the plane orientation of (111). MgO alone constituting the first metallic oxide has a peak at the diffraction angle of 36.9 degrees. SrO alone constituting the second metallic oxide has a peak at the diffraction angle of 30.0 degrees. Therefore, the peak of Point D is present between the peaks of MgO and SrO each used as a single component. Similarly, Point E has a peak at the diffraction angle of 32.8 degrees, and Point E is present between the peaks of MgO constituting the first metallic oxide and BaO constituting the second metallic oxide each used as a single component. Point F has a peak at the diffraction angle of 30.2 degrees, and Point F is present between the peaks of CaO constituting the first metallic oxide and BaO constituting the second metallic oxide each used as a single component.

Therefore, base film 91 of PDP 1 according to the present embodiment includes at least the first metallic oxide and the second metallic oxide. Base film 91 further has at least a peak through an X-ray diffraction analysis. The peak is present at an intermediate position between a first peak through an X-ray diffraction analysis of the first metallic oxide and a second peak through an X-ray diffraction analysis of the second metallic oxide. The first peak and the second peak indicate a plane orientation equal to a plane orientation indicated by the peak of base film 91. The first metallic oxide and the second metallic oxide are two selected from a group consisting of MgO, CaO, SrO, and BaO.

In the description given so far, (111) is used as an example of the crystal orientation plane. In any other plane orientation, the peaks of the metallic oxides are similarly positioned.

Depths of CaO, SrO, and BaO based on a vacuum level are present in a relatively shallow region as compared to MgO. This is a probable cause of increase of electrons released by the Auger effect as compared to transition from the energy level of MgO when electrons present at energy levels of CaO, SrO, and BaO transit to the ground state of Xe ions to drive PDP 1.

As described earlier, the peak of base film 91 according to the present embodiment is present between the peak of the first metallic oxide and the peak of the second metallic oxide. Thus, the energy level of base film 91 is present between the metallic oxides each used as a single component. Therefore, electrons released by the Auger effect are likely to increase as compared to transition from the energy level of MgO.

Because of these facts, base film 91 can exert favorable secondary electron release characteristics as compared to MgO alone, thereby reducing the sustain voltage. When the partial pressure of Xe used as the discharge gas is elevated especially to increase the luminance level, therefore, the discharge voltage can be reduced. As a result, PDP 1 can succeed in the voltage reduction and improvement of the luminance level.

Table 1 shows a sustain voltage result when a mixed gas containing Xe and Ne (Xe by 15%) is enclosed under 60 kPa in PDP 1 according to the present embodiment in which the technical requirement of base film 91 is different.

TABLE 1

| | Sample A | Sample B | Sample C | Sample D | Sample E | Comparative example |
|---|---|---|---|---|---|---|
| Sustain voltage (a.u.) | 90 | 87 | 85 | 81 | 82 | 100 |

The sustain voltage of Table 1 is expressed by relative values based on the value of Comparative Example "100". Base film 91 of Sample A includes MgO and CaO. Base film 91 of Sample B includes MgO and SrO. Base film 91 of Sample C includes MgO and BaO. Base film 91 of Sample D includes MgO, CaO, and SrO. Base film 91 of Sample E includes MgO, CaO, and BaO. Base film 91 of Comparative Example includes MgO alone.

When the partial pressure of the discharge gas Xe is increased from 10% to 15%, the luminance level is improved by approximately 30%. In Comparative Example in which base film 91 includes MgO alone, the sustain voltage is elevated by approximately 10%.

In contrast, the PDP according to the present embodiment can reduce the sustain voltage in any of Sample A, Sample B, Sample C, Sample D, and Sample E by approximately 10% to 20% as compared to Comparative Example. Therefore, voltages within the range of a normal operation can be used as the sustain voltage, and the PDP can achieve a low-voltage drive and a higher luminance level.

Any of CaO, SrO, and BaO has a high degree of reactivity when singly used, therefore, they easily react with an impurity, deteriorating a degree of electron releasability. The present embodiment, however, lessens the reactivity by using the metallic oxides described so far, and provides a crystalline structure in which contamination with an impurity and oxygen deficiency are more unlikely to occur. Therefore, it is prevented that electrons are overly released when the PDP is driven, and suitable charge retention characteristics can be accomplished as well as the other favorable effects which are the low-voltage drive and secondary electron releasability. The charge retention characteristics are advantageous in that wall charges stored in an initialization period are retained to avoid any address error in a address period so that a address discharge is reliably exercised.

[4-2. Details of Agglomerated Particles]

Next, agglomerated particles 92 provided on base film 91 according to the present embodiment are described in detail.

Figure 6:
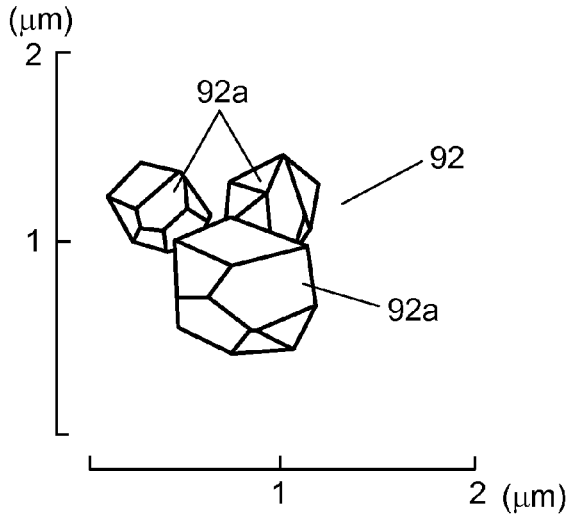
FIG. 6 is an enlarged view of agglomerated particles according to the embodiment.

As illustrated in FIG. 6, a plurality of MgO crystal particles 92*a* agglomerated to one another constitutes agglomerated particles 92. The shape of agglomerated particles 92 can be confirmed by a scan electronic microscope (SEM). According to the present embodiment, agglomerated particles 92 are dispersed evenly on the entire surface of base film 91.

Agglomerated particles 92 each has an average particle diameter in the range of 0.9 μm to 2.5 μm. The average particle diameter recited in the present embodiment is a volume cumulative diameter (D50). To measure the average particle diameter, a particle size distribution measuring apparatus of laser diffraction type, MT-3300 (supplied by NIKKISO CO., LTD.), was used.

Agglomerated particles 92 are not bonded to one another by a strong binding force as a solid matter. Agglomerated particles 92 are an assembly of primary particles gathered by static electricity or van der Waals force. More specifically, agglomerated particles 92 are bound by such an external force, for example, supersonic wave, that all or a part of agglomerated particles 92 are disassembled into primary particles. Agglomerated particles 92 have particle diameters of approximately 1 μm. Crystal particle 92*a* has a polygonal shape having no less than seven surfaces such as cuboctahedron or dodecahedron. Crystal particle 92*a* can be produced by vapor phase synthesis or precursor firing technique described below.

In the vapor phase synthesis, a magnesium (Mg) metallic material having a purity no less than 99.9% is heated in an atmosphere filled with an inactive gas, and a small amount of oxygen is added in an atmosphere for further heating, so that Mg is directly oxidized. Thus, MgO crystal particles 92*a* are obtained.

In the precursor firing technique, crystal particles 92*a* are obtained by the following technique. In precursor firing technique, an MgO precursor is evenly fired at such a high temperature as no less than 700° C. and then slowly cooled down so that MgO crystal particles 92*a* are obtained. The precursor is, for example, at least a compound selected from magnesium alkoxide ($Mg(OR)_2$), magnesium acetyl acetone ($Mg(acac)_2$), magnesium hydroxide ($Mg(OH)_2$), magnesium carbonate ($MgCO_2$), magnesium chloride ($MgCl_2$), magnesium sulfate ($MgSO_4$), magnesium nitrate ($Mg(NO_3)_2$), and magnesium oxalate ($MgC_2O_4$).

Some of the selected compounds may take the form of hydrate, which can also be used. The selected compound is adjusted so that the purity of MgO after the firing is no less than 99.95% or desirably no less than 99.98%. In the case where at least a certain amount of impurity elements, such as alkali metals, B, Si, Fe, or Al, is included in the selected compound, unnecessary inter-particle cohesion or sintering occurs during the heating process, making it difficult to obtain highly crystalline crystal particles 92*a* made of MgO. Therefore, it is necessary to adjust the precursor in advance by removing such an impurity element. The firing temperature or firing atmosphere in the precursor firing technique is adjusted so that the particle diameters are adjusted. The firing temperature is selected from the temperature range of approximately 700° C. to 1,500° C. At a firing temperature no less than 1,000° C., the primary particle diameters can be controlled to about 0.3 μm to 2 μm. Crystal particles 92*a* are obtained in the formation process using the precursor firing technique in the form of agglomerated particles 92 in which the primary particles are agglomerated to one another.

It was confirmed in the tests conducted by the inventors of the present invention that MgO agglomerated particles 92 control a discharge delay mostly in the address discharge and improve a temperature dependency of the discharge delay. The present embodiment, therefore, provides agglomerated particles 92 as an initial electron supplier necessary for a discharge pulse to rise because agglomerated particles 92 exert a better initial electron releasability than base film 91.

A main likely cause of the discharge delay is an insufficient amount of initial electrons to be released as a trigger from the surface of base film 91 into discharge space 16 in an initial stage of the electric discharge. For constant supply of the initial electrons to be released into discharge space 16, MgO agglomerated particles 92 are dispersed on the surface of base film 91. This supplies ample electrons into discharge space 16 during the rise of the discharge pulse, avoiding the discharge delay. As a result of such initial electron releasability, even high-definition PDP 1 can achieve a high-speed drive and a good discharge responsiveness. When agglomerated particles 92 of the metallic oxide are thus provided on the surface of base film 91, the discharge delay which mostly occurs in the address discharge is effectively controlled, and the temperature dependency of the discharge delay can be lessened.

As described so far, PDP 1 according to the present embodiment includes base film 91 which accomplishes a low-voltage drive and a good charge retainability both, and MgO agglomerated particles 92 which effectively prevent a discharge delay. This technical advantage enables PDP 1 with high-definition to be driven fast with a low voltage and to display images with a high quality while avoiding any lighting failure.

[4-3. Test 1]

Figure 7:
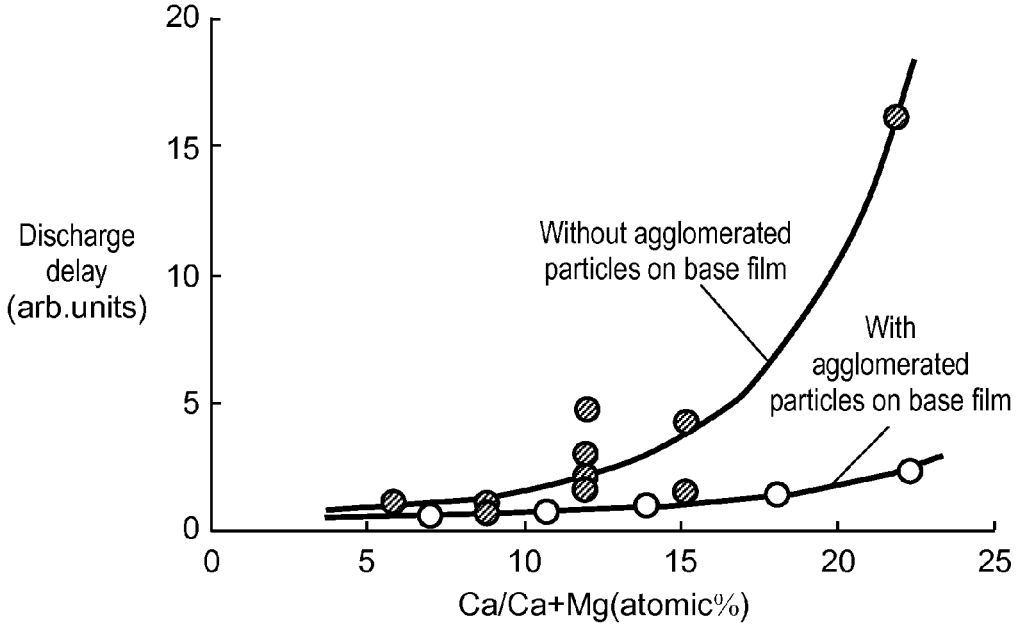
FIG. 7 is a graph illustrating a relationship between a discharge delay and a calcium (Ca) concentration in a protective layer in the PDP according to the embodiment.

FIG. 7 is a graph illustrating a relationship between a discharge delay and a calcium (Ca) concentration in protective layer 9 in the case where base film 91 including MgO and CaO is used in PDP 1 according to the present embodiment. Base film 91 includes MgO and CaO. Base film 91 has a peak between a diffraction angle at which the peak of MgO is generated and a diffraction angle at which the peak of CaO is generated through an X-ray diffraction analysis.

FIG. 7 illustrates an example in which base film 91 alone is used as protective layer 9 and an example in which agglomerated particles 92 are provided on base film 91, and base film 91 not including Ca is used as a standard base film to evaluate the discharge delay.

It is clear from FIG. 7 illustrating the example in which base film 91 alone is used and the example in which agglomerated particles 92 are provided on base film 91 that the discharge delay increases as the Ca concentration is elevated in the example in which base film 91 alone is used, whereas the discharge delay is largely reduced, and the discharge delay hardly increases regardless of the elevated Ca concentration in the example in which agglomerated particles 92 are provided on base film 91.

[4-4. Test 2]

Next, results of tests conducted to confirm the effects of PDP 1 having protective layer 9 according to the present embodiment are described.

PDPs 1 having protective layers 9 differently formed were produced as samples. Sample 1 is PDP 1 having MgO protective layer 9 alone. Sample 2 is PDP 1 having MgO protective layer 9 doped with such an impurity as Al or Si. Sample 3 is PDP 1 in which the primary particles alone of MgO crystal particles 92*a* are dispersed on and adhere to MgO protective layer 9.

Sample 4 is PDP 1 according to the present embodiment. Sample 4 is PDP 1 in which agglomerated particles 92 including MgO crystal particles 92*a* having equal particle diameters and agglomerated to one another adhere evenly to all over the surface of MgO base film 91. Sample A described earlier is used as protective layer 9. Protective layer 9 has base film 91 including MgO and CaO, and agglomerated particles 92 including crystal particles 92*a* agglomerated to one another adhere evenly to all over the surface of base film 91. Base film 91 has a peak between the peaks of the first metallic oxide and the second metallic oxide constituting base film 91 in the X-ray diffraction analysis of the surface of base film 91. In other words, the first metallic oxide is MgO, and the second metallic oxide is CaO. The diffraction angle of the peak of MgO is 36.9 degrees, the diffraction angle of the peak of CaO is 32.2 degrees, and the diffraction angle of the peak of base film 91 is 36.1 degrees.

The electron releasability and charge retainability were measured in these PDPs 1 respectively having four different protective layers.

As a numerical value of the electron releasability is larger, more electrons are released. The electron releasability is expressed in the form of an initial electron release amount determined by a discharge surface condition, type of gas, and condition of gas. The initial electron release amount can be measured by measuring an electron current amount released from the surface when ion or electronic beam is irradiated thereon, however, it is difficult to perform the measurement in a non-destructive approach. Therefore, the method disclosed in Unexamined Japanese Patent Publication No. 2007-48733 was used. Of delay times during the electric discharge, a numerical value as an indicator of a degree of dischargeability, called a statistical delay time, was measured. When an inverse number of the statistical delay time is integrated, a numerical value linearly corresponding to the initial electron release amount is obtained. The discharge delay time is a delay time of the address discharge from the rise of the address discharge pulse. A main likely cause of the discharge delay is that there is some difficulty in the release of the initial electrons which trigger the address discharge from the protective layer surface into the discharge space.

An indicator used to evaluate the charge retainability is a voltage value (hereinafter, called Vscn lighting voltage) applied to the scan electrodes to control the charge release when PDP 1 is produced. As the Vscn lighting voltage is lower, the charge retainability is higher because the PDP can be driven with a lower voltage as the Vscn lighting voltage is lower. Because of this advantage, any parts having a lower breakdown voltage and a smaller capacity can be used as a power supply and electric components. Among the products currently available, devices having a breakdown voltage of approximately 150 V are conventionally used as a semiconductor switching element such as MOSFET used for sequential application of the scan voltage to a plate. The Vscn lighting voltage is desirably no more than 120 V in view of temperature-dependent variability.

Figure 8:
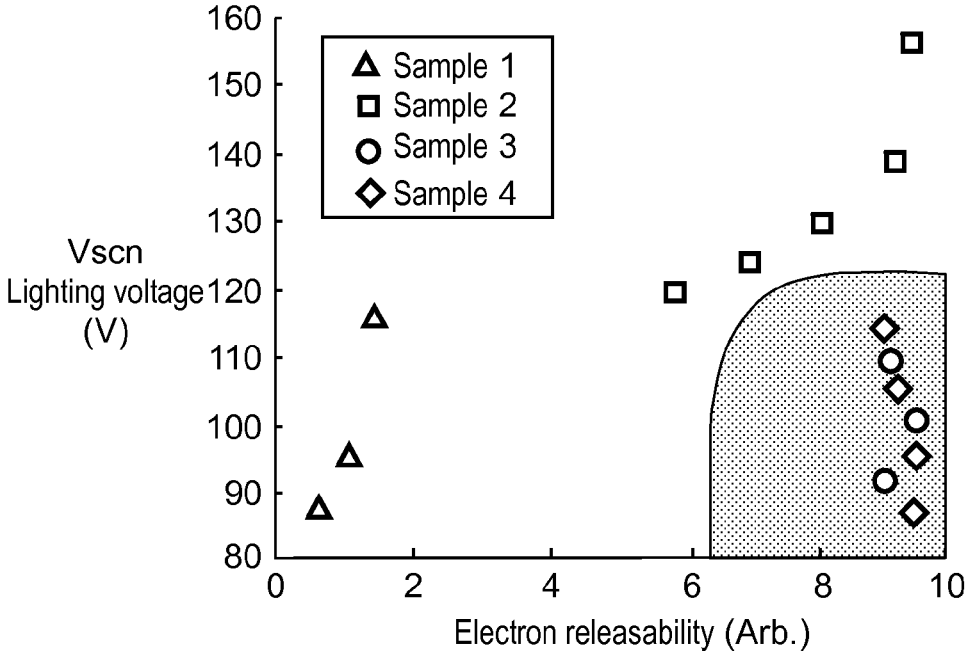
FIG. 8 is a graph illustrating a relationship between an electron releasability and a Vscn lighting voltage in the PDP.

As is clear from FIG. 8, Sample 4 succeeded in reducing the Vscn lighting voltage to no more than 120 V in the evaluation of the charge retainability, and further succeeded in achieving significantly improved characteristics as compared to the electron releasability of Sample 1 in which MgO is the only material of the protective layer.

In general, the electron releasability and the charge retainability of the protective layer in PDP contradict with each other. When, for example, deposition conditions of the protective layer are changed or the protective layer is doped with an impurity such as Al, Si, or Ba to form film, the electron releasability can be improved. This, however, brings an adverse effect, which is increase of the Vscn lighting voltage.

The PDP having protective layer 9 according to the present embodiment can attain the electron releasability eno less than 8 and the charge retainability that the Vscn lighting voltage is no more than 120 V. More specifically, protective layer 9 thus obtained has the electron releasability and the charge retainability which are good enough for any PDP wherein there are more scan lines to meet the demand of a higher definition and cells are increasingly downsized.

[4-5. Test 3]

Below is described in detail the particle diameter of agglomerated particles 92 used in protective layer 9 of PDP 1 according to the present embodiment. The particle diameter recited in the following description is an average particle diameter, and the average particle diameter is a volume cumulative diameter (D50).

Figure 9:
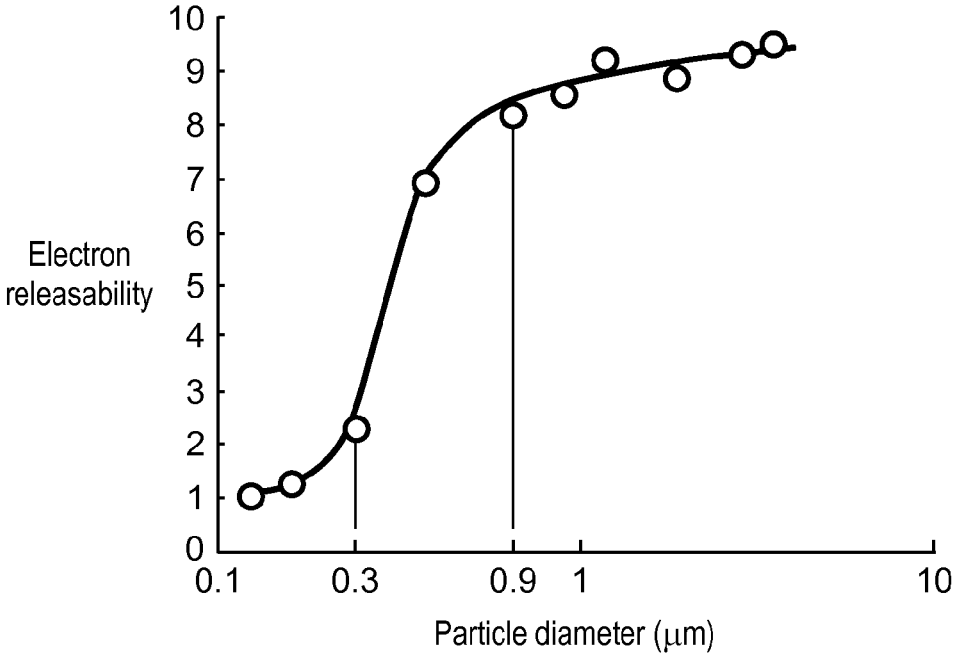
FIG. 9 is a graph illustrating a relationship between the electron releasability and an average particle diameter of the agglomerated particles according to the embodiment.

FIG. 9 illustrates a test result of the electron releasability checked by changing the average particle diameter of MgO agglomerated particles 92 in protective layer 9. Referring to FIG. 9, agglomerated particles 92 were observed by SEM so that the average particle diameter of agglomerated particles 92 was measured.

As illustrated in FIG. 9, the electron releasability declines when the average particle diameter is as small as approximately 0.3 μm. As far as the average particle diameter is no less than approximately 0.9 μm, the electron releasability of an expected level can be obtained.

Figure 10:
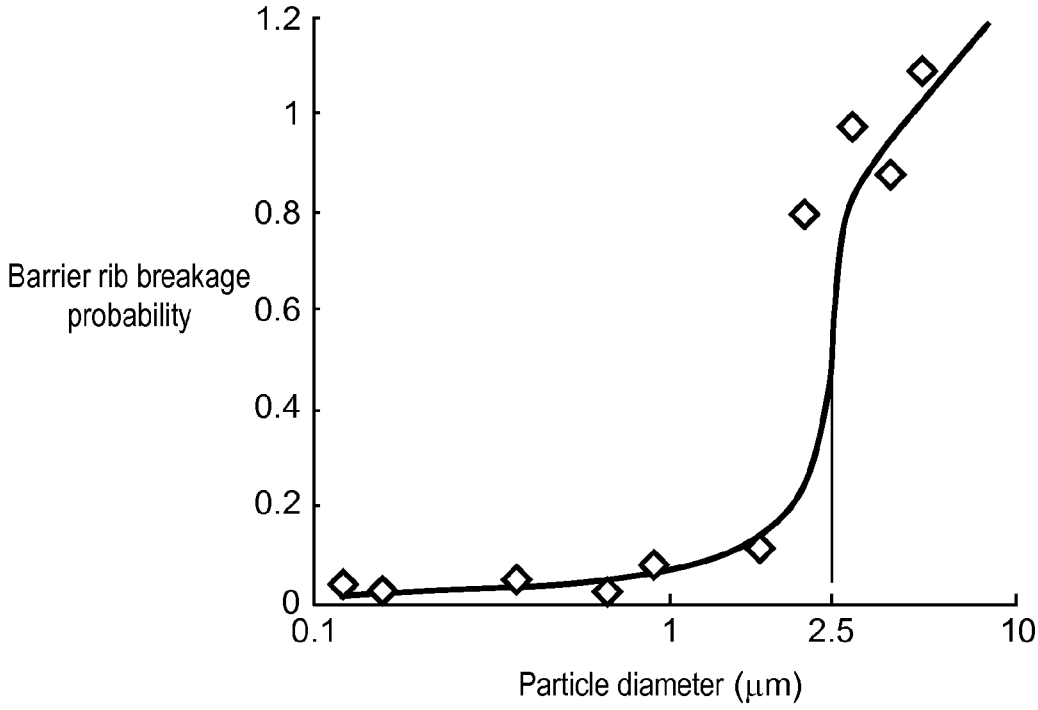
FIG. 10 is a graph illustrating a relationship between a barrier rib breakage probability and the average particle diameter of the agglomerated particles according to the embodiment.

To increase the number of electrons released in the discharge cell, number of crystal particles per unit area of protective layer 9 is desirably larger. It was learnt from the tests conducted by the inventors of the present invention that the top portions of barrier ribs 14 may be broken in the case where crystal particles 92*a* are present on or near barrier ribs 14 in close contact with protective layer 9, in which case the components of broken barrier ribs 14 might drop on the phosphors, possibly failing to light on or off any relevant cell normally. Such an unfavorable event as the breakage of the barrier rib is unlikely to occur as far as crystal particles 92*a* are not present at the top portions of the barrier ribs, meaning that the chances of the breakage of barrier ribs 14 are higher as more crystal particles adhere to the layer. FIG. 10 illustrates a test result of the probability of the barrier rib breakage obtained by changing the average particle diameter of agglomerated particles 92. As illustrated in FIG. 10, the probability of the barrier rib breakage soars when the average particle diameter of agglomerated particles 92 is no less than 2.5 μm, while the probability of the barrier rib breakage is relatively low as far as the average particle diameter is smaller than 2.5 μm.

As described, PDP 1 having protective layer 9 according to the present embodiment can gain the electron releasability no less than 8 and the charge retainability that the Vscn lighting voltage is no more than 120 V.

The crystal particles described in the present embodiment are MgO particles. A similar effect can be exerted by other single crystal particles, for example, crystal particles obtained from a metallic oxide capable of a high electron releasability similarly to MgO, such as Sr, Ca, Ba, or Al. Therefore, the particles are not necessarily limited to MgO.

[5. Details of Protective Layer Formation Steps S13]

Figure 11:
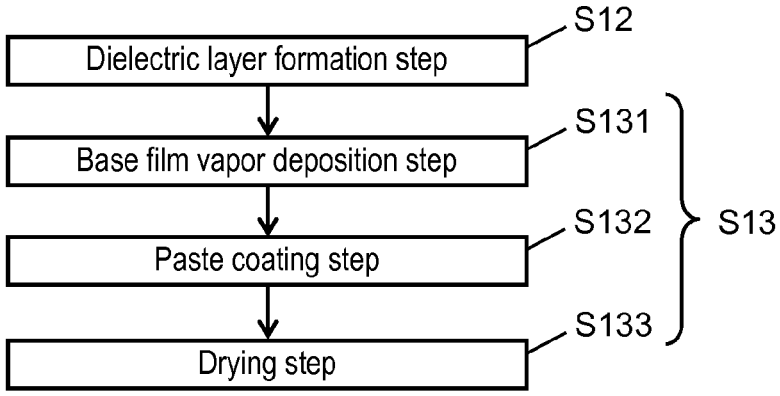
FIG. 11 is a flow chart illustrating protective layer formation steps according to the embodiment.
Figure 12:
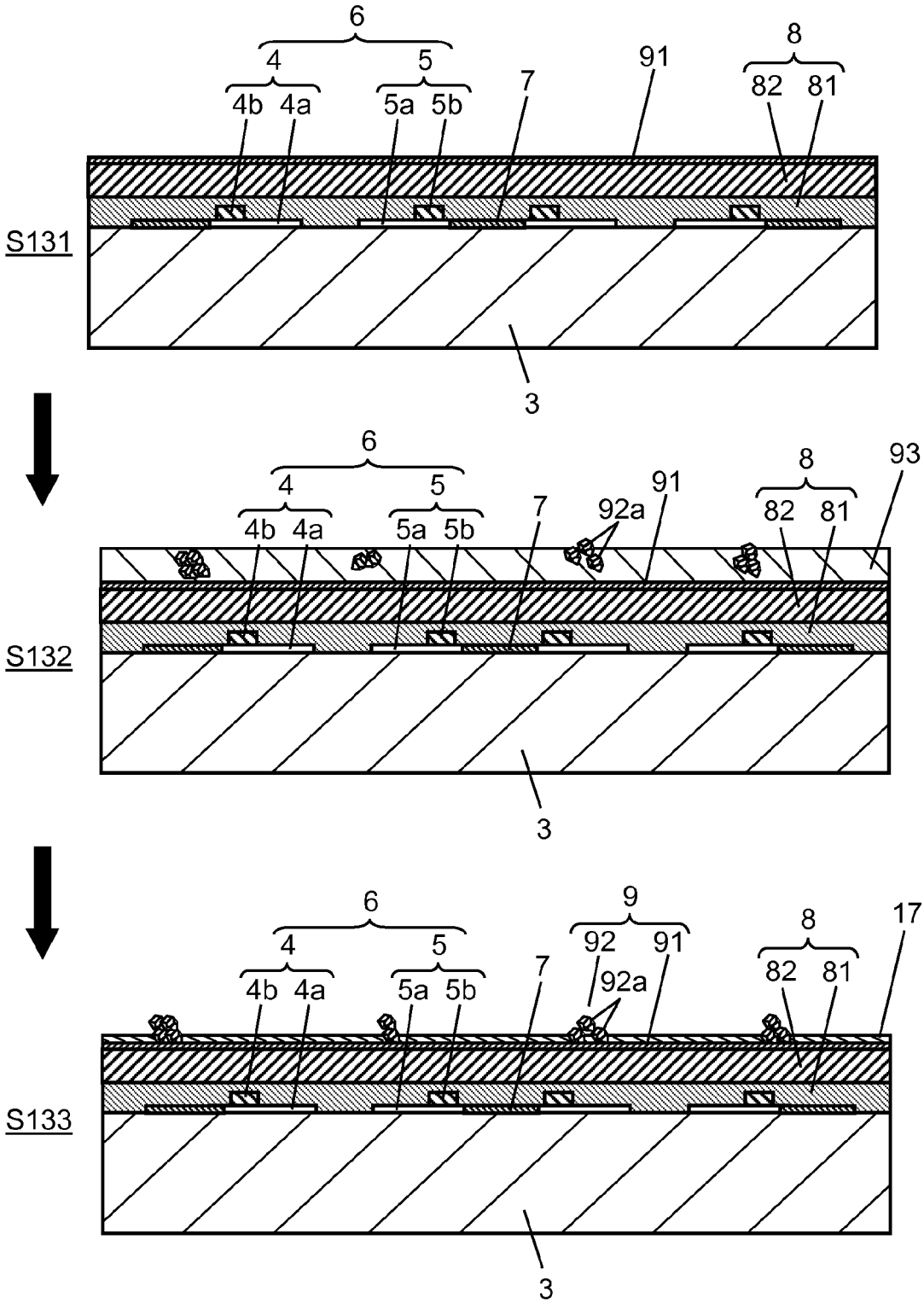
FIG. 12 is a pictorial drawing of the protective layer formation steps according to the embodiment.

Next, protective layer formation steps S13 in PDP 1 according to the present embodiment are described referring to FIGS. 11 and 12.

As illustrated in FIG. 11, protective layer formation steps S13 include base film vapor deposition step S131, paste coating step S132, and drying step S133 after dielectric layer formation step S12 in which dielectric layer 8 is formed.

As illustrated in FIG. 12, base film vapor deposition step S131 forms base film 91 on dielectric layer 8 by vacuum vapor deposition. A raw material used in vacuum vapor deposition is a pellet in which MgO alone, CaO alone, SrO alone, or BaO alone is used, or a pellet in which these materials are mixed. Other than the vacuum vapor deposition, electron beam deposition, sputtering, or ion plating, for example, may be employed.

In paste coating step S132 and drying step S133, organic solvent coating film 17 is formed on an entire surface of unfired base film 91. Base film 91 may be fired prior to paste coating step S132.

In paste coating step S132, agglomerated particles 92 are dispersed in an organic solvent so that an agglomerated particle paste is prepared. Then, base film 91 is coated with the agglomerated particle paste so that agglomerated particle paste film 93 having an average film thickness of no less than 8 μm and no more than 20 μm is formed thereon as a coating layer. The agglomerated particle paste is spread on base film 91 by screen printing, spraying, spin coating, die coating, or slit coating. The average film thickness of agglomerated particle paste film 93 is more desirably no less than 8 μm and no more than 12 μm though it may depend on the conditions of drying step S133 described later. The average film thickness is desirably set in the mentioned range because it is time-consuming to dry agglomerated particle paste film 93 having the average film thickness larger than 12 μm in drying step S133, and it is difficult to evenly disperse agglomerated particles 92 on base film 91 in the case where the average film thickness of agglomerated particle paste film 93 is smaller than 8 μm.

The organic solvent used in the production of the agglomerated particle paste preferably has a good affinity with base film 91 and agglomerated particles 92. Examples of the solvent are an organic solvent in which methyl methoxy butanol, terpineol, propylene glycol, or benzyl alcohol is dissolved as a single component, or a solvent in which these substances are mixed. The paste containing the organic solvent thus obtained has a viscosity in the range of several mPa·s to several ten mPa·s.

Front glass substrate 3 coated with the agglomerated particle paste is immediately transferred to drying step S133. Drying step S133 dries agglomerated particle paste film 93 under a reduced pressure so that the organic solvent of agglomerated particle paste film 93 is removed therefrom. During the removal of the organic solvent, agglomerated particles 92 are dispersed on and adhere to base film 91. The organic solvent of agglomerated particle paste film 93, however, partly remains on base film 91, forming organic solvent coating film 17 having an average film thickness of no less than 1 nm and no more than 50 nm thereon. Drying step S133 will be described in further detail later.

According to the method, agglomerated particles 92 can be evenly dispersed on and adhere to the entire surface of base film 91, and organic solvent coating film 17 can be formed on base film 91.

A conventional PDP production method is described below. According to the conventional PDP production method, the firing step follows the drying step in the protective layer formations steps. In the firing step, front glass substrate 3 already dried in the drying step is fired at a temperature of several hundred degrees, and the organic solvent still left in protective layer 9 is completely removed in the firing step.

However, base film 91 once exposed to the atmosphere starts to react with CO-based impurities, easily deteriorating its properties. The reaction with the CO-based impurities forms carbonate on the surface of base film 91. As the surface of base film 91 is deteriorated, the secondary electron releasability of base film 91 declines, thereby increasing the sustain voltage of PDP 1. The carbonate formed on the surface of base film 91 is a compound, which cannot be easily removed in the production process. To remove calcium carbonate, for example, formed on the surface of base film 91 through thermolysis, base film 91 should be heated at a temperature no less than 825° C. This raises the need to arrange an additional step other than a simple heat treatment.

According to the method for producing PDP 1 provided by the present embodiment, organic solvent coating film 17 is formed on base film 91 in drying step S133. Because drying step S133 is not followed by the firing step, coating film 17 is not removed in protective layer formation steps S13. The method for producing PDP 1 according to the present embodiment can prevent base film 91 exposed to the atmosphere from reacting with CO-based impurities in the atmosphere. The method for producing PDP 1 according to the present embodiment evaporates coating film 17 in sealing and evacuation step S32 and removes the components of coating film 17 from discharge space 16. Organic solvent coating film 17 merely adhere to base film 91 without any reaction therebetween, therefore, can be easily removed when heated in sealing and evacuation step S32.

Therefore, base film 91 according to the present embodiment can prevent the secondary electron releasability from deteriorating. As a result, PDP 1 produced by the production method according to the present embodiment can prevent base film 91 from deteriorating to thereby succeed in reducing the sustain voltage.

[6. Details of Drying Step S133]

Drying step S133 is described in detail below. In drying step S133, a vacuum chamber is used. The vacuum chamber is provided with a gate unit, and front glass substrate 3 is transferred to and from the vacuum chamber through the gate unit. The vacuum chamber is connected to a dry pump. The dry pump controls an internal pressure of the vacuum chamber. There is a table placed in the vacuum chamber. The table has an immobilization mechanism.

First, front glass substrate 3 having base film 91 on which agglomerated particle paste film 93 is formed is transported through the gate unit into the vacuum chamber. Front glass substrate 3 is set on the table with base film 91 facing upward. Next, the internal pressure of the vacuum chamber is reduced to a predetermined pressure level by the dry pump. According to the present embodiment, the internal pressure of the vacuum chamber is reduced to 9 Pa. The internal pressure of the vacuum chamber is reduced to 9 Pa in two to three minutes.

In drying step S133, agglomerated particle paste film 93 is dried in the vacuum chamber. In drying step S133, convection, which is a notable phenomenon in heat dry, does not occur in agglomerated particle paste film 93. Therefore, agglomerated particles 92 adhereevenly to the surface of base film 91.

Drying step S133 dries agglomerated particle paste film 93, while leaving a part of the organic solvent unremoved. As a result, organic solvent coating film 17 having an average film thickness of no less than 5 nm and no more than 20 nm is formed on base film 91. According to the present embodiment, coating film 17 is formed on the surface of base film 91 alone.

Though organic solvent coating film 17 is formed on the surface of base film 91 alone in the present embodiment, coating film 17 may be formed on the surfaces of agglomerated particles 92 as well. When coating film 17 is formed on the surface of base film 91 alone, a coating removal step described later is simplified because it is easier to evaporate coating film 17 from the surface of base film 91 alone than evaporating coating film 17 from agglomerated particles 92 which requires additional condition setting. As far as coating film 17 is formed on at least base film 91, the effect of the present embodiment can be accomplished.

The internal pressure of the vacuum chamber is preferably reduced to no more than 50 Pa because the internal pressure higher than 50 Pa requires more time to dry agglomerated particle paste film 93, making it difficult to evenly disperse agglomerated particles 92. The internal pressure of the vacuum chamber is more preferably reduced to no more than 20 Pa because agglomerated particles 92 can be more evenly dispersed and adhere.

When, for example, the internal pressure of the vacuum chamber is reduced from the atmospheric pressure to no more than 20 Pa within five minutes in drying step S133, coating film 17 can be formed on the surface of base film 91 alone.

The average film thickness of organic solvent coating film 17 is preferably no less than 1 nm and no more than 50 nm. The average film thickness preferably stays in the mentioned range because it takes more time to evaporate and remove coating film 17 from base film 91 in the case where the average film thickness is larger than 50 nm, and it fails to coat a part of base film 91 with coating film 17 in the case where the average film thickness is smaller than 1 nm. The average film thickness of organic solvent coating film 17 is more preferably no less than 5 nm and no more than 20 nm because the entire surface of base film 91 can be more reliably coated, and it takes even a shorter amount of time to evaporate and remove coating film 17 from base film 91.

[6-1. Coating Removal Technique]

In the event that the components of organic solvent coating film 17 formed on base film 91 are left in discharge space 16 after PDP 1 is produced, there are such problems that the discharge voltage becomes variable, and the sputtering resistance of protective layer 9 is deteriorated. Therefore, it is necessary to remove coating film 17 during the production of PDP 1 before the discharge gas is enclosed therein. According to the present embodiment, coating film 17 is evaporated from base film 91, and the components of coating film 17 are removed from discharge space 16 in sealing and evacuation step S32. A technique for removing coating film 17 is described below.

In alignment step S31, front plate 2 provided with coating film 17 and rear plate 10 are disposed facing each other. Front plate 2 and rear plate 10 are disposed facing each other with a sealing member provided in peripheral portions of the substrates interposed therebetween, and then temporarily fixed by, for example, clips and put in a sealing furnace. Rear plate 10 is provided with an air evacuation tube made of, for example, a glass material which communicates with discharge space 16 through exhaust holes. The exhaust tube is connected to an intra-plate air evacuation device and a discharge gas introduction device. An example of the sealing member is a low melting glass whose softening point is 380° C.

Then, in sealing and evacuation step S32, front plate 2 and rear plate 10 facing each other are heated so that coating film 17 is evaporated and agglomerated particles 92 are evenly dispersed on base film 91, and the components of evaporated coating film 17 are removed from discharge space 16.

First, the sealing furnace is vacuumized to around $1\times10^{-2}$ Pa. At the time, discharge space 16 and the sealing furnace have an equal internal pressure because front plate 2 and rear plate 10 are not sealed yet.

To evaporate coating film 17 at a temperature no more than 380° C. which is the softening point of the sealing member, the sealing furnace is continuously evacuated and heated at the same time until front plate 2 and rear plate 10 reach around 350° C., and left for 10 minutes at the temperature. Then, the components of coating film 17 formed on base film 91 are evaporated so that agglomerated particles 92 are dispersed on base film 91. Further, the components of evaporated coating film 17 are removed from discharge space 16. Preferably, front plate 2 and rear plate 10 are heated and the sealing furnace is evacuated at the same time because it avoids such an unfavorable event that the components of coating film 17 evaporated by heating front plate 2 and rear plate 10 adhere again to base film 91.

While the evacuation of discharge space 16 continues, the sealing furnace is heated until front plate 2 and rear plate 10 reach a temperature higher than 380° C. which is the softening point of the sealing member, for example, about 420° C., and then left for 10 minutes at the temperature, so that the sealing member is fully melted. Then, the temperature of sealing furnace is reduced to, for example, 300° C. which is a temperature lower than the softening point of the sealing member so that front plate 2 and rear plate 10 are sealed to each other.

Discharge space 16 is continuously evacuated until $1\times10^{-4}$ Pa is obtained, and the discharge gas is enclosed in discharge space 16 by the discharge gas introduction device. The discharge gas, for example, a mixed gas containing Ne and Xe, is introduced under the pressure of 66.5 kPa, and the exhaust tube is sealed. Then, front plate 2 and rear plate 10 are removed from the sealing device.

Thus, the production of PDP 1, wherein rear plate 10 and front plate 2 from which coating film 17 is evaporated are sealed to each other, is completed.

[6-2. Test 4]

Below are described a result of a test conducted to confirm the effects of the PDP 1 production method according to the present embodiment. The inventors of the present invention prepared three different PDP samples in which the composition of base film 91 and protective layer formation steps S13 were changed. The inventors measured the initial sustain voltages of the samples. In the PDP of Sample 1, base film 91 including MgO alone was formed in base film vapor deposition step S131, and the firing step was performed after drying step S133. In the PDP of Sample 2, base film 91 of Sample A described earlier was formed in base film vapor deposition step S131. Base film 91 of Sample 2, therefore, includes MgO and CaO. The PDP of Sample 2 was subjected to the firing step after drying step S133. In the PDP of Sample 3, base film 91 of Sample A described earlier was formed in base film vapor deposition step S131. In the PDP of Sample 3, organic solvent coating film 17 was formed on base film 91 in drying step S133, but was not subjected to the firing step after drying step S133. In Sample 1 and Sample 2, the firing step was performed at 500° C. in the ambient atmosphere.

The initial sustain voltages of these samples were measured, and Sample 1 was used as a standard example to measure relative sustain voltages of these samples. The relative sustain voltage of the PDP of Sample 2 was −20.21 (V) based on the sustain voltage of the PDP of Sample 1=0 (V). It is known that the PDP of Sample 2 significantly lowered the sustain voltage as compared to the PDP of Sample 1. Such a sustain voltage reduction can be accomplished because base film 91 of the PDP of Sample 2 includes MgO and CaO. Thus, the PDP of Sample 2 can have a lower sustain voltage because base film 91 includes two different metallic oxides. The relative sustain voltage of the PDP of Sample 3 was −29.41 (V) based on the sustain voltage of the PDP of Sample 1=0 (V). It is known that the PDP of Sample 3 significantly lowered the sustain voltage as compared to the PDP of Sample 2 and the PDP of Sample 1 both. Such a sustain voltage reduction can be accomplished because organic solvent coating film 17 was formed on base film 91 in drying step S133 but was not removed due to the omission of the firing step after drying step S133. Coating film 17 formed on base film 91 blocks CO-based impurities from adhering to the surface of base film 91 during exposure to the atmosphere. Therefore, PDP 1 of Sample 3 can prevent base film 91 from deteriorating, thereby reducing the sustain voltage. Also, it was confirmed in PDP 1 of Sample 3 that coating film 17 was completely removed from discharge space 16 in sealing and evacuation step S32.

According to the method for producing PDP 1 provided by the present embodiment wherein coating film 17 is formed, it is unnecessary to prepare such a gas atmosphere as vacuum, nitrogen, a mixed gas of nitrogen and oxygen, or rare gas for the transport of front glass substrate 3 provided with protective layer 9, thereby simplifying a production facility.

The method for producing PDP 1 according to the present embodiment can form coating film 17 in protective layer formation steps S13 without performing the firing step. The production method according to the present embodiment can evaporate formed coating film 17 in sealing and evacuation step S32 in which front plate 2 and rear plate 10 are sealed to each other. Therefore, a step for removing coating film 17 is unnecessary, and the firing step can be omitted. As a result, a production facility can be simplified.

[7. Wrap-Up]

The present embodiment relates to a method for producing PDP 1. PDP 1 has rear plate 10 and front plate 2 sealed to rear plate 10. Front plate 2 includes dielectric layer 8 and protective layer 9 which covers dielectric layer 8. Protective layer 9 includes base film 91 which is a base layer formed on dielectric layer 8. Agglomerated particles 92 in which crystal particles of magnesium oxide are agglomerated to one another are dispersed evenly on an entire surface of base film 91. Base film 91 includes at least a first metallic oxide and a second metallic oxide. Base film 91 further has at least a peak through an X-ray diffraction analysis. The peak of base film 91 is present at an intermediate position between a first peak through an X-ray diffraction analysis of the first metallic oxide and a second peak through an X-ray diffraction analysis of the second metallic oxide. The first peak and the second peak indicate a plane orientation equal to a plane orientation indicated by the peak of the base layer. The first metallic oxide and the second metallic oxide are two selected from a group consisting of magnesium oxide, calcium oxide, strontium oxide, and barium oxide.

The method for producing PDP 1 according to the present embodiment includes the steps of: forming base film 91 on dielectric layer 8; spreading an organic solvent in which agglomerated particles 92 are dispersed on base film 91 to form thereon agglomerated particle paste film 93 which is a coating layer; drying agglomerated particle paste film 93 under a reduced pressure to form organic solvent coating film 17 on at least base film 91; disposing rear plate 10 and front plate 2 on which coating film 17 is formed so as to face each other; heating front plate 2 and rear plate 10 facing each other to evaporate coating film 17, dispersing agglomerated particles 92 evenly on base film 91, and removing the components of evaporated coating film 17 from discharge space 16; and sealing rear plate 10 and front plate 2 from which coating film 17 is evaporated.

As a result of the steps described so far, the method for producing PDP 1 according to the present embodiment can form organic solvent coating film 17 on the surface of base film 91 in drying step S133. PDP 1 produced by the production method according to the present embodiment can thus prevent base film 91 from deteriorating to thereby succeed in reducing the sustain voltage. PDP 1 can further prevent the charge retainability of base film 91 from deteriorating. According to the method for producing PDP 1 provided by the present embodiment, organic solvent coating film 17 formed in drying step S133 can be evaporated in sealing and evacuation step S32. According to the method for producing PDP 1 provided by the present embodiment, it is unnecessary to perform the firing step after drying step S133, thereby simplifying a production facility.

Industrial Applicability

The technology disclosed in the present embodiment is useful in realizing low power PDP having a display performance with a higher definition and a higher luminance.

REFERENCE MARKS IN THE DRAWINGS

| | |
|---|---|
| 1 | PDP |
| 2 | front plate |
| 3 | front glass substrate |
| 4 | scan electrode |
| 4a, 5a | transparent electrode |
| 4b, 5b | bus electrode |
| 5 | sustain electrode |
| 6 | display electrode |
| 7 | black stripe |
| 8 | dielectric layer |
| 9 | protective layer |
| 10 | rear plate |
| 11 | rear glass substrate |
| 12 | data electrode |
| 13 | base dielectric layer |
| 14 | barrier rib |
| 15 | phosphor layer |
| 16 | discharge space |
| 17 | coating film |
| 81 | first dielectric layer |
| 82 | second dielectric layer |
| 91 | base film |
| 92 | agglomerated particles |
| 92a | crystal particles |
| 93 | agglomerated particle paste film |

The invention claimed is:

1. A method for producing a plasma display panel having a rear plate and a front plate sealed to the rear plate with a discharge space interposed therebetween, wherein the front plate includes a dielectric layer and a protective layer which covers the dielectric layer, the protective layer including a base layer formed on the dielectric layer, agglomerated particles in which crystal particles of magnesium oxide are agglomerated to one another are dispersed evenly on an entire surface of the base layer, the base layer includes at least a first metallic oxide and a second metallic oxide, and has at least a peak through an X-ray diffraction analysis, the peak of the base layer is present at an intermediate position between a first peak through an X-ray diffraction analysis of the first metallic oxide and a second peak through an X-ray diffraction analysis of the second metallic oxide, the first peak and the second peak indicate a plane orientation equal to a plane orientation indicated by the peak of the base layer, and the first metallic oxide and the second metallic oxide are two selected from a group consisting of magnesium oxide, calcium oxide, strontium oxide, and barium oxide, the method for producing the plasma display panel comprising:

forming the base layer on the dielectric layer; then spreading an organic solvent, in which the agglomerated particles are dispersed, on the base layer to form a coating layer; and then drying the coating layer under a reduced pressure to form an organic solvent coating film on at least the base layer; next disposing the rear plate and the front plate on which the coating film is formed so as to face each other; then heating the front plate and the rear plate facing each other to evaporate the coating film, dispersing the agglomerated particles on the base layer, and removing components of the evaporated coating film from the discharge space; and then sealing the rear plate and the front plate from which the coating film is evaporated to each other.

2. The method for producing the plasma display panel according to claim 1, comprising:

drying the coating layer under a pressure reduced to no more than 50 Pa to form the organic solvent coating film on at least the base layer.

3. The method for producing the plasma display panel according to claim 2, comprising:

drying the coating layer under a pressure reduced from atmospheric pressure to no more than 50 Pa within five minutes to form the organic solvent coating film on at least the base layer.

4. The method for producing the plasma display panel according to claim 1, comprising:

heating the front plate and the rear plate facing each other and evacuating the discharge space to evaporate the coating film, dispersing the agglomerated particles on the base layer, and removing components of the evaporated coating film from the discharge space.

5. The method for producing the plasma display panel according to claim 1, comprising:

forming the organic solvent coating film on the surface of the base layer alone.

6. The method for producing the plasma display panel according to claim 1, comprising:

forming the organic solvent coating film having an average film thickness of no less than 1 nm and no more than 50 nm on at least the base layer.

7. The method for producing the plasma display panel according to claim 1, comprising:

spreading the organic solvent in which the agglomerated particles are dispersed on the base layer to form the coating layer having an average film thickness of no less than 8 nm and no more than 12 nm.

* * * * *